United States Patent [19]

Suzuki et al.

[11] Patent Number: 4,737,315

[45] Date of Patent: Apr. 12, 1988

[54] METHOD OF TREATING RADIOACTIVE ORGANIC WASTES

[75] Inventors: Kazunori Suzuki; Akihiro Yamanaka, both of Yokohama; Hiroshi Kuribayashi, Kanagawa, all of Japan

[73] Assignee: JGC Corporation, Chiyoda, Japan

[21] Appl. No.: 943,895

[22] Filed: Dec. 18, 1986

Related U.S. Application Data

[63] Continuation of Ser. No. 618,119, Jun. 7, 1984, abandoned.

[30] Foreign Application Priority Data

Jun. 8, 1983 [JP] Japan ..... 58-102384

[51] Int. Cl.[4] ..... G21F 9/08; G21F 9/14

[52] U.S. Cl. ..... 252/632; 110/237; 110/342; 159/47.3; 159/DIG. 12; 219/759; 219/763; 252/186.28; 252/626; 432/21; 432/24

[58] Field of Search ..... 252/631, 632, 626, 186.21, 252/186.22, 186.1, 186.27, 186.28, 186.29; 210/759, 758, 763; 110/237, 204, 342; 159/DIG. 12, 47.3; 432/9, 14, 21, 24

[56] References Cited

U.S. PATENT DOCUMENTS

| | | | |
|---|---|---|---|
| 3,666,673 | 5/1972 | Knoll | 252/632 |
| 3,803,295 | 4/1974 | Cathers et al. | 252/632 |
| 3,914,388 | 10/1975 | Cathers et al. | 252/631 |
| 4,086,325 | 4/1978 | Cordier et al. | 252/632 |
| 4,340,490 | 7/1982 | Junkermann et al. | 210/759 |
| 4,370,241 | 1/1983 | Junkermann et al. | 210/759 |
| 4,377,508 | 3/1983 | Rothberg | 252/631 |

FOREIGN PATENT DOCUMENTS

| | | | |
|---|---|---|---|
| 0001446 | 1/1982 | Japan . | |
| 0191599 | 11/1982 | Japan . | |
| 0052599 | 3/1983 | Japan | 252/631 |
| 0072099 | 4/1983 | Japan . | |
| 0184900 | 10/1984 | Japan | 252/632 |
| 0184898 | 10/1984 | Japan | 252/632 |

*Primary Examiner*—Stephen J. Lechert, Jr.
*Assistant Examiner*—Howard J. Locker
*Attorney, Agent, or Firm*—Armstrong, Nikaido, Marmelstein & Kubovcik

[57] ABSTRACT

Radioactive organic wastes, such as granular or powdered ion exchange resins and organic filter aids, are treated by oxidation decomposition using hydrogen peroxide in the presence of iron ions in an aqueous medium under refluxing an effluent which is condensed from evaporated components during the oxidation. Condensed water containing a very small amount of organic matter is obtained.

2 Claims, No Drawings

METHOD OF TREATING RADIOACTIVE ORGANIC WASTES

The present application is a continuation of application Ser. No. 618,119 filed 6-7-84 which has been abandoned.

BACKGROUND OF THE INVENTION

1. Field of the Invention

The present invention relates to an improved method for the treatment of radioactive organic wastes wherein the wastes are decomposed by oxidation through the use of hydrogen peroxide.

2. State of the Art

At a nuclear power plant, condensed water, which is obtained through evaporation and concentration carried out at the time of treatment of waste water containing radioactive material, undergoes removal of salt and is reused. Because the granular or powdered ion exchange resins used in this process are contaminated with radioactive material, they should be treated to be made harmless. There is a similar problem concerning the organic filter aids which are used in the filtering of waste water.

The ultimate treatment of these radioactive organic wastes is solidification using cement, asphalt, or plastic. But, in order to isolate the wastes as safely as possible from the environment for a long period of time, and in order to decrease the volume as much as possible, it is desirable to proceed with the solidification process after the organic compounds in the radioactive wastes have been transformed into inorganic substances such as $CO_2$ or $H_2O$ through decomposition by oxidation.

The decomposition by oxidation of the organic solid wastes is broadly divided into dry methods and wet methods. Included in the latter wet method are the acid decomposition method, the Zimmermann Process, and the hydrogen peroxide method. The prior art relating to the hydrogen peroxide method includes a technique for oxidizing ion exchange resins in the presence of iron ions and/or chromium ions (Japanese Patent Disclosure Number 57-1446), a technique using anion exchange resins in the presence of (bi) chromate ions (Japanese Patent Disclosure Number 57-191599), and a method, proposed by the applicant, which oxidizes anion exchange resins, chelate resins, and filter sludge, all in the presence of iron ion and/or cation exchange resins (Japanese Patent Disclosure Number 58-72099).

In any of the known methods, evaporation of water from the system occurs vigorously because the reaction is carried out at a temperature raised to a certain point in order to promote decomposition by oxidation, and also due to heat generated by the reaction. The concentrated residual liquid is solidified, and the effluent, after being purified by desalting, is reused.

However, there are problems with the prior art. The effluent contains a large amount of organic matter which is considered an intermediate product (not yet a final oxidized substance such as $CO_2$ or $H_2O$) of the oxidation reaction. This organic matter increases the burden on salt removal equipment, bringing about the need for a process to treat the remaining organic matter.

SUMMARY OF THE INVENTION

The object of the present invention is to solve this problem, and provide a treatment method to reduce to the lowest possible level the organic matter in the effluent, which is generated through a decomposition by oxidation reaction using hydrogen peroxide.

The characteristic feature of the method of present invention for treating radioactive organic wastes is in the treatment method comprising decomposition by oxidation acting on radioactive organic solid wastes using hydrogen peroxide in the presence of iron ions in an aqueous medium to carry out an oxidation reaction while the effluent, which is the condensate of the components evaporated during the oxidation reaction, is returned to the reaction system.

Here, effluent means, of course, not only a liquid which is the condensate of the components vigorously evaporated from a reaction carried out under boiling, but also a liquid which is obtained by cooling and condensing the components evaporated from a system not yet having reached a boiling state.

As can be easily understood, it is desirable to carry out the above-mentioned method in batch, but there is the possibility of also utilizing the continuous method. In the batchwise method, hydrogen peroxide is added, at a suitable reaction temperature, to an aqueous system containing iron ions and organic solid wastes, and return of the effluent to the system continues. The addition of hydrogen peroxide stops when the intended decomposition by oxidation has been completed. Then, evaporation and concentration are carried out, and the residue and the effluent which contains almost no organic matter are recovered separately. The continuous method is carried out under continuous addition of hydrogen peroxide and waste matter to the reaction system, and by the refluxing and extraction of a portion of the effluent. Because the higher the reflux ratio of the effluent the lower the amount of organic matter in the extracted liquid. The ratio of reflux and extraction should be determined according to the content of the organic matter which is permitted in the subsequent treatment process.

The conditions under which the reaction should be employed when the treatment method of the present invention is implemented are preferably those in the previously indicated Japanese Patent Disclosure Number 58-72099.

With the present invention, not only is it possible to lower, to several ppm what normally may be as high as 20 ppm, the amount of organic matter in the effluent, but it is also possible to reduce the level of the amount of organic matter in the residual liquid to several ppm or less. This is accomplished by thorough oxidation of the organic wastes with hydrogen peroxide. The period necessary for the treatment is approximately equal, but even if longer, the prolonged period is quite short. On the other hand, the hydrogen peroxide consumption is rather small in comparison with those of the prior technology. This is a remarkable advantage of the present method.

Comparative Example (without refluxing)

Fifty grams (dry basis) each of granular cation exchange resin "Amberlite IR-120B", granular anion exchange resin "Amberlite IRA-400", and both of these together in a 1:2 mixture, respectively, were added to 1000 ml aqueous solutions containing 0.02 mole of $Fe^{++}$ ions.

While the solutions were being heated at 100° C., 35% $H_2O_2$ was supplied continuously at a rate of 250 ml/hr., and the decomposition by oxidation reaction was carried out over a 6 hour period.

During the reaction the evaporated component was condensed, and when entirely withdrawn, amounted to approximately 1300 ml. The TOC (total organic carbon) content of the effluent and the residual liquid was determined, and the decomposition rate of the organic matter was calculated. The results are shown in Table 1. Decomposition was obtained at a high rate, but the TOC content of the effluent was high, particularly when the cation exchange resin was subjected to the decomposition, and the carbon content was even higher than the TOC content of the residual liquid.

Example 1

The same three materials as in the comparative example were added to 500 ml aqueous solutions containing 0.02 mole of $Fe^{++}$, and 35% $H_2O_2$ was added continuously at a rate of 125 ml/hr. The decomposition by oxidation reaction was carried out through heating. All of the effluent generated during the decomposition at a rate of 100–120 ml/hr. was refluxed to the reaction system continuously.

After a lapse of 6 hours, when the reaction liquid reached approximately 1000 ml, addition of the 35% $H_2O_2$ was stopped, heating continued, and evaporation and concentration was carried out. Approximately 500 ml each of the effluent and the residual liquid were obtained.

The decomposition rate and the TOC content of the materials are described in Table 2. The TOC content of the effluent fell to 25 mg even in cases when anion exchange resin was used, and is regarded as a marked improvement.

TABLE 1

| Material Subjected to Treatment | Decomposition Rate (%) | Residual Liquid TOC Content (mg) | Effluent TOC Content (mg) |
|---|---|---|---|
| Amberlite IR-120B | 89 | 27 | 140 |
| Amberlite IRA-400 | 91 | 2500 | 330 |
| 1:2 Mixture | 96 | 880 | 170 |

TABLE 2

| Material Subjected to Treatment | Decomposition Rate (%) | Residual Liquid TOC Content (mg) | Effluent TOC Content (mg) |
|---|---|---|---|
| Amberlite IR-120B | 100 | 3 | 0.5 |

TABLE 2-continued

| Material Subjected to Treatment | Decomposition Rate (%) | Residual Liquid TOC Content (mg) | Effluent TOC Content (mg) |
|---|---|---|---|
| Amberlite IRA-400 | 93 | 2200 | 25 |
| 1:2 Mixture | 96 | 1100 | 13 |

EXAMPLE 2

Fifty grams (dry basis) of granular ion exchange resin "Powdex PCH" and "PAO" mixed in a 1:1.5 ratio, respectively, by weight, underwent decomposition by oxidation, with all of the effluent being refluxed to the reaction, as in Example 1. After the reaction was completed, the resulting liquid was evaporated and concentrated. The results were as follows:

| Decomposition Rate (%) | Residual Liquid TOC Content (mg) | Effluent TOC Content (mg) |
|---|---|---|
| 100 | 1 | 0.1 |

EXAMPLE 3

Using an organic matter filter aid "KC Flock" the decomposition by oxidation treatment was carried out, as in Example 2, and the following results were obtained:

| Decomposition Rate (%) | Residual Liquid TOC Content (mg) | Effluent TOC Content (mg) |
|---|---|---|
| 100 | 1 | 0.1 |

We claim:

1. In a method of treating radioactive organic wastes wherein the radioactive organic solid wastes are decomposed by oxidation using hydrogen peroxide in the presence of iron ions in an aqueous medium and an effluent results from condensation of vapor products of the oxidation reaction, the improvement wherein the effluent is refluxed back to the oxidation system so as to further decompose the organic matters resulting from incomplete oxidation.

2. The improvement in a method of treatment according to claim 1 in which the radioactive organic solid wastes consist of one or more of the following: granular ion exchange resins, powdered ion exchange resins, and organic filter aids.

* * * * *